United States Patent [19]

Wirtz et al.

[11] 4,079,911

[45] Mar. 21, 1978

[54] BATTERY GRID CASTING MOLD

[75] Inventors: John W. Wirtz; Jack E. McLane, both of Port Huron, Mich.

[73] Assignee: Wirtz Manufacturing Company, Inc., Port Huron, Mich.

[21] Appl. No.: 734,118

[22] Filed: Oct. 20, 1976

[51] Int. Cl.[2] ..... B22D 27/04

[52] U.S. Cl. ..... 249/78; 164/DIG. 1; 164/338 R; 164/348; 249/79; 264/327

[58] Field of Search ..... 249/78, 79, 80, 81; 164/82, 273 R, 338, 348, DIG. 1; 425/243, DIG. 110, DIG. 208; 264/327

[56] References Cited

U.S. PATENT DOCUMENTS

| | | | |
|---|---|---|---|
| 1,819,444 | 8/1931 | Sherts | 264/327 |
| 2,508,865 | 5/1950 | Lund | 249/60 |
| 2,646,601 | 7/1953 | Jung | 164/338 M |
| 3,507,939 | 4/1970 | Williams | 264/327 X |
| 3,651,861 | 3/1972 | Deuring | 249/79 X |

*Primary Examiner*—Francis S. Husar
*Assistant Examiner*—John S. Brown
*Attorney, Agent, or Firm*—Barnes, Kisselle, Raisch & Choate

[57] ABSTRACT

The two half sections of a battery grid mold are provided with means for cooling the portions of the mold sections directly adjacent the grid cavity and for heating the larger rear portions of the mold sections. The means for cooling the mold sections comprise a plurality of coolant passageways disposed forwardly of the vertical mid-plane of each mold section.

10 Claims, 8 Drawing Figures

BATTERY GRID CASTING MOLD

This invention relates to molds for casting battery grids and, more particularly, to a means for controlling the temperature of such molds.

In a conventional battery grid casting mold where hot liquid alloys are poured into the mold, the inner faces of the two mold half sections (in which the grid cavity is machined) heat up and tend to warp the mold sections. For this reason and also because it is desirable to maintain the mold as a whole within a selected close range of temperatures in order to produce sound castings efficiently, it is common practice to heat the back side of each mold section. Normally electric heaters are mounted on or within the back portion of the mold sections to maintain the mold at the desired casting temperature. Likewise, coolant lines are frequently formed in the vertical mid-plane of each mold section to cool the grid faces of the mold to the temperature desired for causing solidification of the grid casting within a relatively short time period.

As the production rate on a grid casting machine is increased the temperature of the mold tends to increase as does the tendency for the mold to warp. Mold warpage is minimized to some extent by utilizing large anti-warping bars on the mold sections. Conventional molds have produced generally satisfactory results when grids are cast at a rate of not more than about 16 per minute.

When it is attempted to increase production on a conventional mold to a rate above about 16 grids per minute, the consequent increase in the mold temperature amplifies the problems encountered. Mold warping becomes more pronounced and cannot be overcome by simply increasing the heat supplied to the rear portion of the mold because the temperature of the mold as a whole is already too high to produce sound castings. With an excessively high mold temperature the time required for solidification of the cast grid increases. This problem cannot be solved by cooling the mold at a more rapid rate because the drastic chilling of the casting produces a microstructure which is undesirable.

The object of the present invention is to enable casting battery grids at a higher rate than is obtainable with a conventional mold while simultaneously avoiding the problems of mold warpage and unsatisfactory castings.

More specifically, the object of the invention resides in cooling a battery grid casting mold in such a manner as to concentrate the cooling effect to a narrow zone directly adjacent the grid cavity. This narrow cooling zone serves to more efficiently cool the grid faces of the mold and thereby reduce the amount of heat required to be applied to the major portion of the mass of the mold. The net result is that mold warpage is controlled at a lower temperature which in turn permits an accelerated casting speed.

Other objects, features and advantages of the present invention will become apparent from the following description and accompanying drawings, in which.

Figure 2:
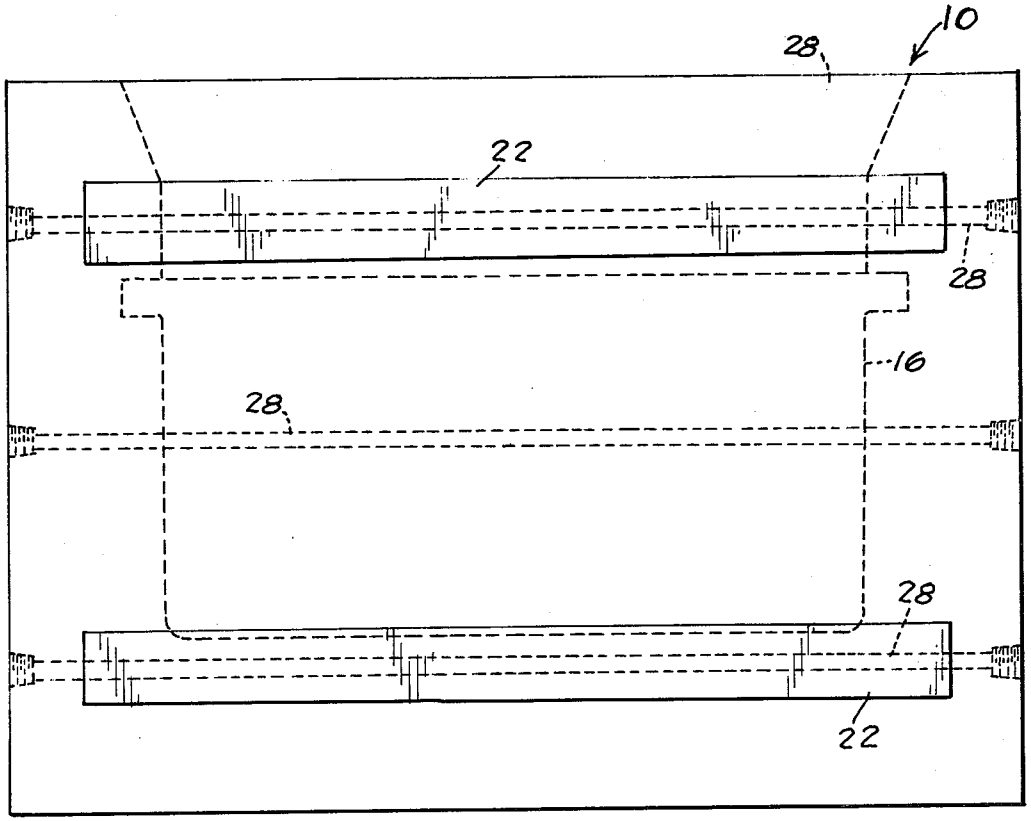
FIG. 2 is an elevational view of the back face of one of the mold sections.

In the drawings, there is illustrated a battery grid casting mold comprising two complementary half sections 10 and 12 which are of generally rectangular shape. The mold sections are preferably formed as metal castings and each has a recess 14 machined in the front face 15 thereof. One of the mold sections is stationary and the other is movable to open and close the mold. When the mold sections are closed the recesses 14 cooperate to define a cavity 16 which corresponds to the grid to be cast. The two half sections are also machined with gate portions 18 at the upper end thereof for filling the grid cavity 16 with molten metal, such as lead. Since the manner in which the two mold sections are supported and opened and closed and the manner in which the grid is ejected from the mold form no part of the present invention, the mounting structure and the grid ejection mechanism are not illustrated in the drawings. Except for such mechanism (not shown), the two mold sections are of generally the same construction.

Figure 1:
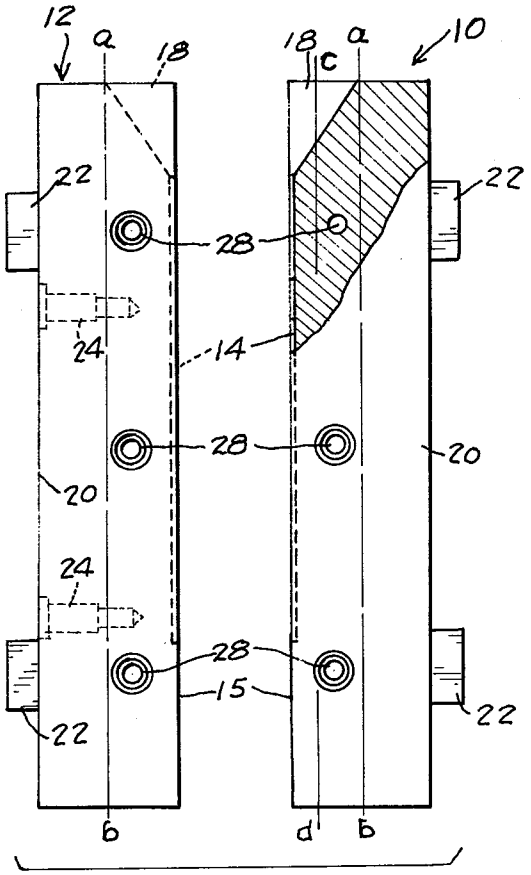
FIG. 1 is an end view, partly in section, of complementary mold half sections constructed in accordance with the present invention.

In the embodiment illustrated in FIGS. 1 and 2 the back faces 20 of mold sections 10,12 have electrical heaters 22 mounted thereon. In the arrangement illustrated heaters 22 are in the form of elongate bars which extend horizontally across the back face of the mold adjacent the upper and lower edges of the grid cavity area of the mold. Thermocouples (not shown) are mounted in the stationary mold section within sockets 24 which extend inwardly of the mold section from the back surface 20 thereof to a point adjacent the die cavity 16. The thermocouples measure the temperature of the mold directly behind the grid cavity adjacent the upper and lower ends thereof. The heat supplied to the back side of the mold by heaters 22 is controlled in response to the temperatures measured by the thermocouples in sockets 24.

As pointed out above, the front faces 15 of the two mold sections become heated as a result of pouring the hot liquid alloy into the grid cavity during each casting cycle. Accordingly, it is necessary to cool the front portion of each mold section to maintain the mold at a temperature suitable for casting the grids. In the arrangement illustrated the means for cooling the front portions of the mold sections comprise a plurality of horizontally extending passageways 28 through which coolant is directed. As is clearly shown in FIG. 1, passageways 28 are located forwardly of the laterally extending vertical mid-plane *a–b* of each mold section. This is an important feature of the present invention. In addition, it is important that passageways 28 are located in a plane behind recesses 14 in each mold section. The latter plane is designated *c–d* and should be spaced behind the recesses a distance of at least 0.15 inch.

When the coolant passageways 28 are located in the zone defined between the planes *a–b* and *c–d*, the speed at which the grids can be cast is appreciably higher than with molds where the coolant passageways are located at or behind the lateral vertical mid-plane of the mold section. By locating the coolant lines 28 in this zone, the effective cooling is concentrated to a relatively small mass (as compared with the entire mass of the mold section) directly behind the grid cavity. Thus, with this arrangement the temperature of the larger portion of each mold section can be maintained at a desirable low value suitable for casting the grids and the narrow zone directly behind the grid cavity in each mold section can be cooled efficiently to permit casting grids at a relatively high rate. For example, with molds constructed in accordance with the present invention sound grids can be cast at a rate of at least 18 per minute, which is higher than attainable with conventional battery grid molds. In addition, by concentrating the cooling to a relatively narrow zone directly behind the grid cavity, the mold can be operated at a relatively low temperature and at a high speed with a minimum of heat supplied to the greater portion of the mass of the mold section by the heaters 22. This, of course, minimizes the tendency for the mold to warp. Thus, as compared with conventional battery grid molds, molds according to the present invention enable a faster casting rate with less warpage.

As shown in FIG. 2, the coolant passageways 28 extend horizontally between opposite ends of the mold sections. These passageways are arranged one adjacent the upper end of the grid area, one adjacent the lower end of the grid area, and one adjacent the vertically central portion of the grid area. The coolant flow through each passageway 28 is preferably controlled independently by valves (not shown) so that the temperatures of the mold throughout the vertical extent of the grid cavity can be selectively controlled to the desired values.

Figure 4:
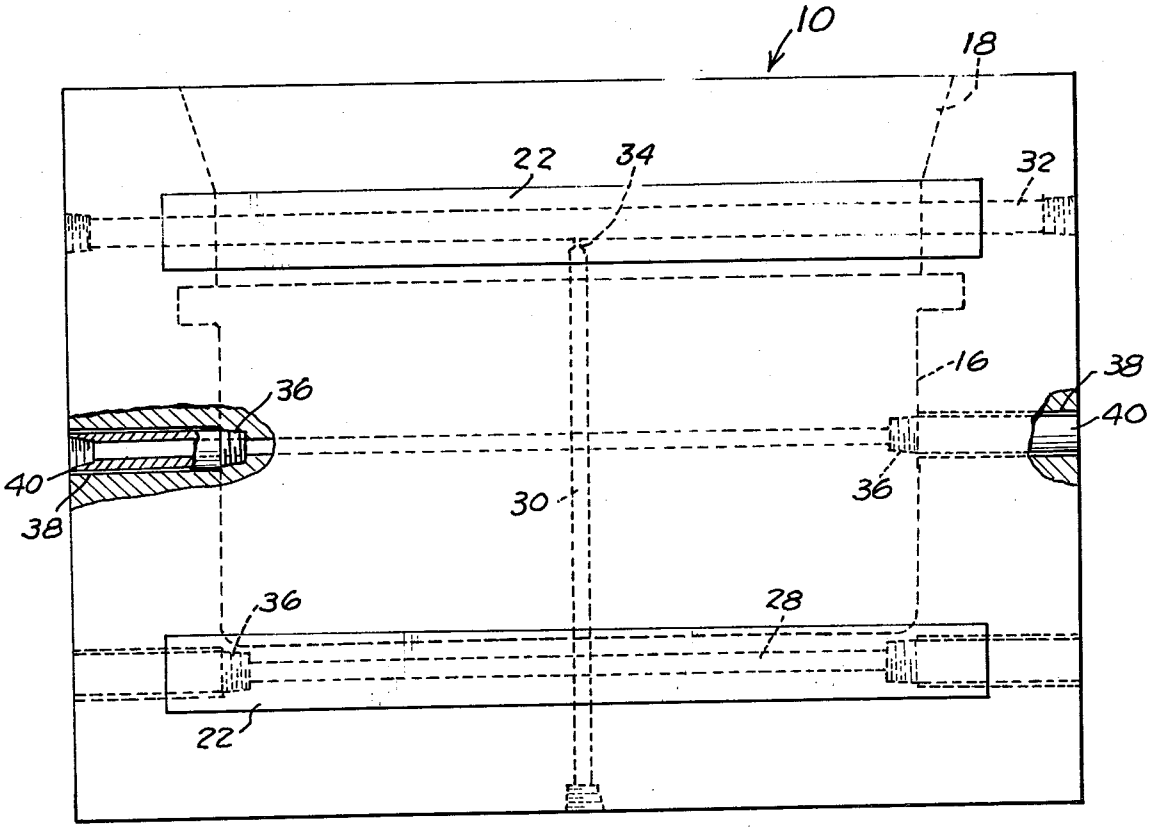
FIGS. 3 through 8 are views similar to FIGS. 1 and 2 and showing various embodiments of the invention.
Figure 3:
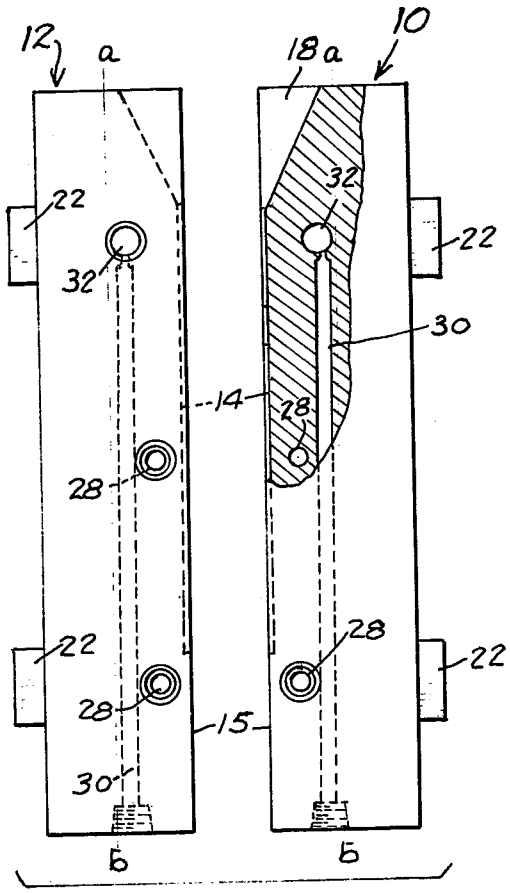

The arrangement shown in FIGS. 3 and 4 is generally the same as that shown in FIGS. 1 and 2. However, the mold sections in FIG. 4 have an additional coolant passageway 30 extending vertically at the central portion of the grid area. Passageway 30 extends upwardly from the lower end of the mold and is connected to the upper horizontally extending coolant passageway 32 by means of a restricted orifice 34 which controls the amount of coolant in passageway 32 which is diverted downwardly through passageway 30. In addition, in the arrangement shown in FIGS. 3 and 4 the two lower horizontally extending coolant passageways 28 terminate at each end inwardly of the opposite ends of the mold sections as at 36. The opposite ends of the mold sections are formed with enlarged bores 38 concentric with passageways 28 which are threaded as at 36 to receive a coolant pipe 40. Pipes 40 extend into enlarged bores 38 out of contact with the walls thereof so that the cooling effect of the fluid directed through these pipes is concentrated within the grid area of each mold section. This further tends to minimize warpage because it is primarily the portion behind the grid area of the mold section which tends to become heated to a higher temperature due to the casting of the grids. When the mold section includes horizontal as well as vertically extending coolant passageways, these are all located in their entirety forwardly of the vertical mid-plane *a–b* of the mold sections. It will be appreciated, of course, that, although a single coolant passageway 30 is illustrated in FIGS. 3 and 4, several of such coolant passageways may be employed, if desired.

Figure 6:
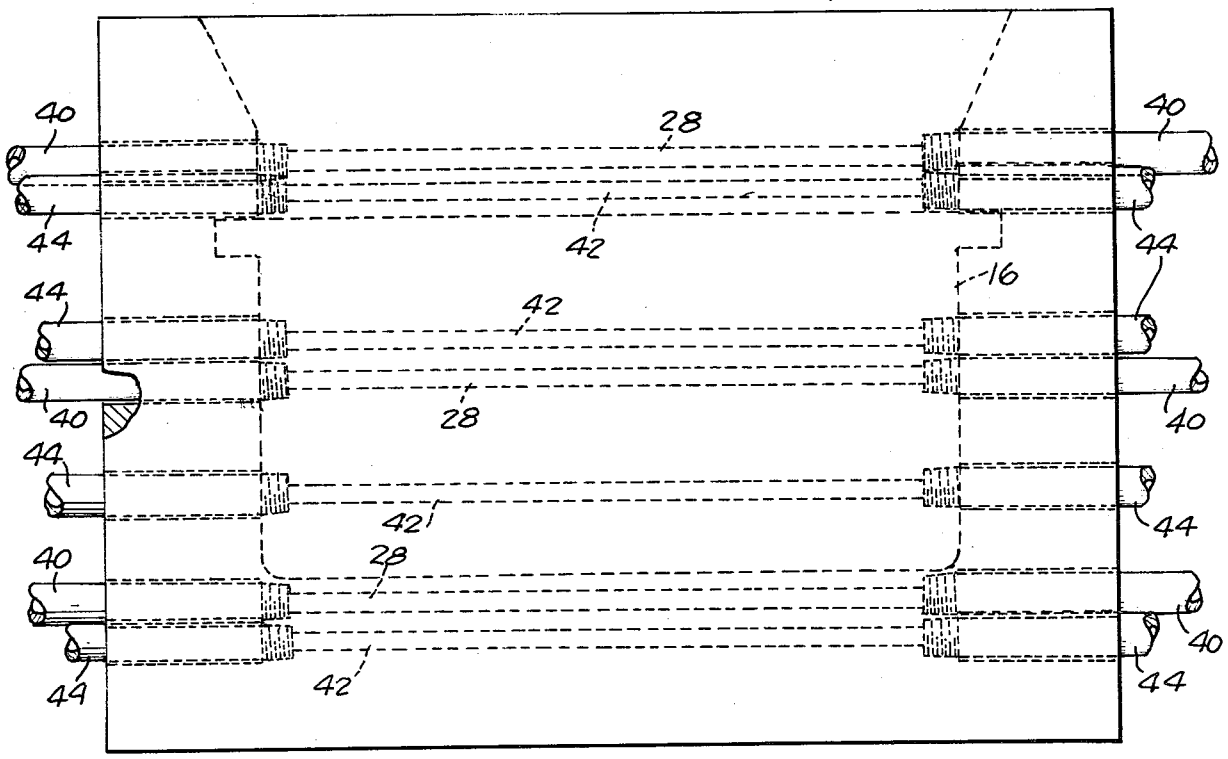
Figure 5:
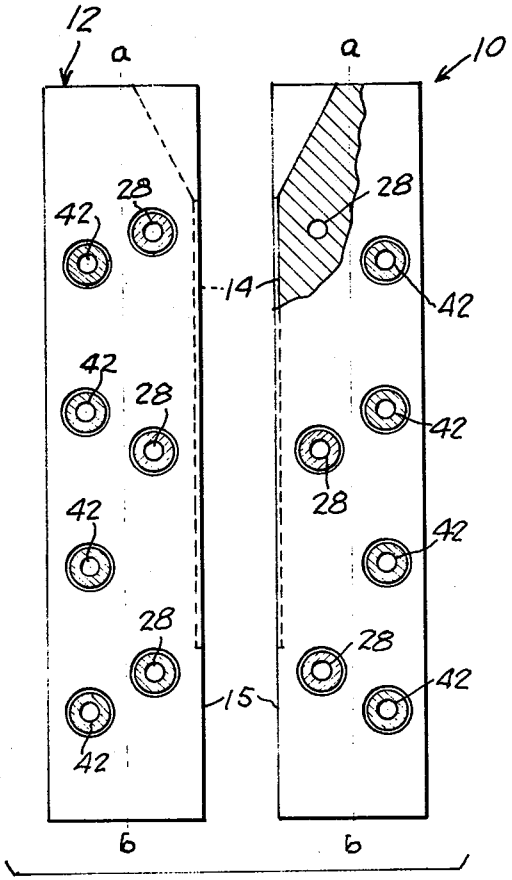

In FIGS. 5 and 6 the coolant passageways 28 are arranged in a manner similar to that illustrated in FIGS. 1 and 2. However, heat is supplied to the back portion of each mold section by means of heated fluid, such as oil, which is directed through horizontally extending passageways 42. Passageways 42 are all located in a zone behind the vertical mid-plane *a–b* of the mold section. Thus, the cooled portion of each mold section is compressed to a zone of narrow width directly adjacent the mold cavity and the larger mass of each mold section can be heated to the desired temperature by the fluid directed through passageways 42. In the arrangement illustrated in FIGS. 5 and 6 the heating effect of the fluid conducted through passageways 42 is more or less restricted to the grid cavity area of the mold by means of pipes 44 arranged in a manner similar to pipes 40. If desired, electric cartridge heaters can be inserted in passageways 42 instead of conducting heating fluid therethrough.

Figure 8:
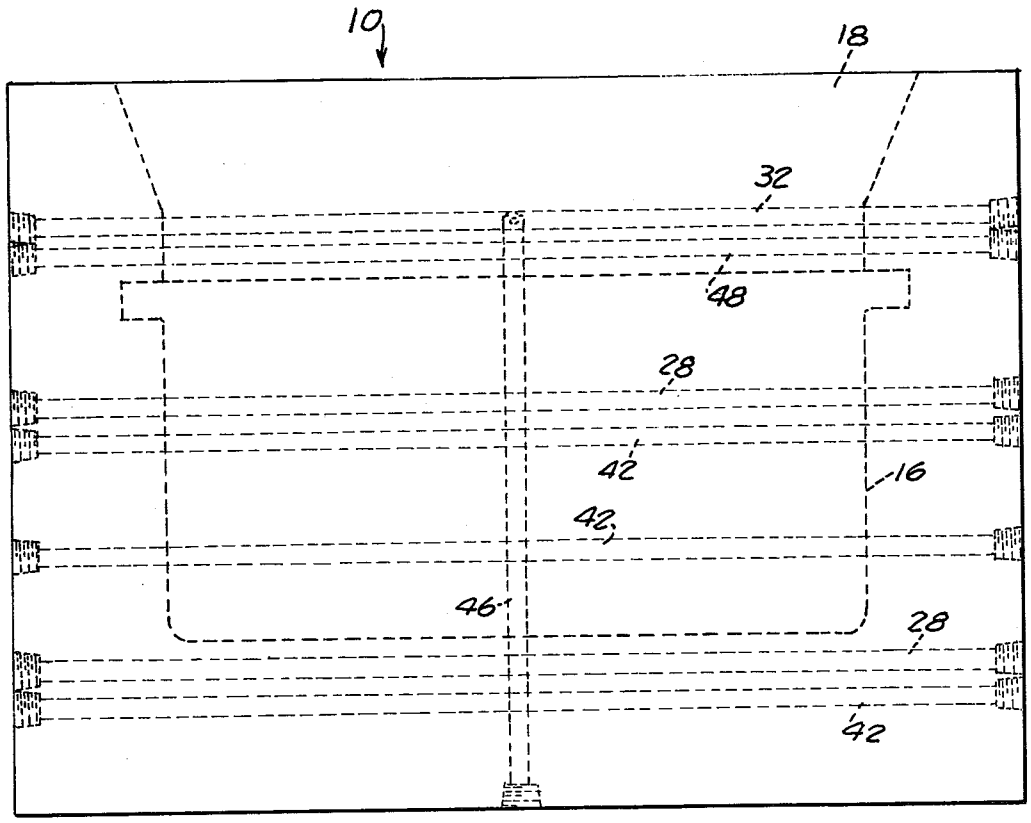
Figure 7:
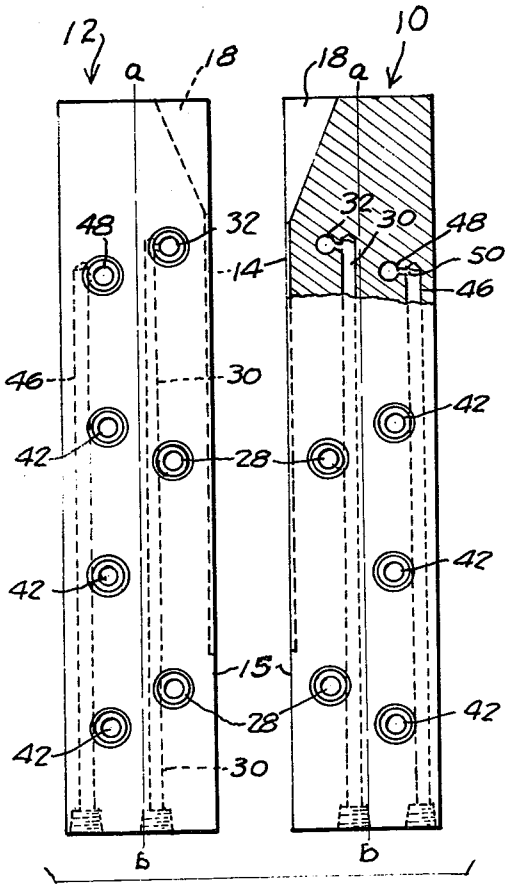

In the mold sections illustrated in FIGS. 7 and 8 the coolant passageways are the same as illustrated in FIGS. 3 and 4 and include the central vertical passageway 30 connected to the upper horizontally extending passageway 32. Likewise, the heating fluid passageways 42 are arranged in the same manner as those illustrated in FIGS. 5 and 6. However, in the arrangement shown in FIGS. 7 and 8 an additional heating fluid passageway 46 is employed. Passageway 46 extends vertically upwardly from the bottom face of the mold and is connected to the upper horizontally extending heating fluid passageway 48 by a restricted orifice 50. In other respects the mold sections shown in FIGS. 7 and 8 are the same as the mold sections previously described.

In each of the embodiments illustrated the coolant passageways are located in a relatively narrow zone forwardly of the vertical mid-plane of the mold section. As pointed out previously, this zone may extend to within about 0.15 inch from the recesses defined by the grid cavity. Experience has shown that the forward side of this zone should be located at least about 0.15 inch behind the grid cavity in order to prevent localized super-cooling of the grid. By locating the coolant passageways forwardly of the vertical central plane of each mold section, an efficient cooling of the grid area of the mold is obtainable. Such efficient cooling minimizes the heat input required to the back portion of the mold. This in turn results in a lower operating temperature for the mold as a whole and reduces warpage. At the same time it permits casting the grids at a relatively high rate.

We claim:

1. A mold for casting metal alloy battery grids comprising a pair of complementary mold sections adapted to be moved relative to one another to and from closed position, each of said mold sections being of generally rectangular shape in vertical section and having a front face and a back face, the front face of the mold sections having juxtaposed shallow recesses therein which, when the mold sections are closed, define a battery grid casting cavity, each recess extending across the major portion of said front face in both lateral and vertical directions, there being a pouring gate for molten metal along the upper edge thereof, each mold section having at least three generally parallel, coolant circulating passageways extending tranversely across and behind the grid cavity area of the mold sections, one adjacent each of the upper and lower edges of the grid cavity and at least one intermediate said upper and lower edges of the grid cavity, each of said coolant passageways lying in its entirety in a vertical zone extending forwardly from the central vertical mid plane of the mold section to a vertical plane closely adjacent, but spaced rearwardly of, the cavity defining recess, whereby to concentrate the coolant effect of the coolant circulated through said passageways to said relatively narrow vertical zone directly behind and adjacent the mold cavity in each section, the thickness of said zone being many times greater than the depth of said recesses, and a plurality of at least two generally parallel heating devices on each mold section, each of said heating devices being located in its entirety in a second vertical zone extending rearwardly of said vertical mid plane, said heating devices being located generally in opposed relation with at least the coolant passageways adjacent the upper and lower edges of the grid cavity to concentrate heating of the mold section to said second zone at the rear of each mold section and thereby balance the cooling of the front portion of the mold section to minimize warpage of the mold sections.

2. A mold as called for in claim 1 wherein said heating devices comprise electrically heated elements.

3. A mold as called for in claim 2 wherein said electrically heated elements are located on the back faces of the mold sections.

4. A mold as called for in claim 1 wherein said heating devices comprise passageways in said mold sections and means for directing heated fluid through said last-mentioned passageways.

5. A mold as called for in claim 4 wherein the grid area of the mold is spaced laterally inwardly of the opposite ends of the mold, at least some of said heating fluid passageways extending horizontally across the cavity area of the mold and including conduits extending into opposite ends of the mold sections in spaced relation thereto and connected to said heating fluid passageways directly adjacent laterally opposite ends of the cavity area whereby to concentrate the heating to the cavity area of each mold section.

6. A mold as called for in claim 1 wherein the forward side of said first zone is spaced at least 0.15 inch rearwardly of the cavity defining recess in the front face of the mold section.

7. A mold as called for in claim 1 wherein at least some of said coolant passageways extend vertically across the central portion of the cavity area of the mold section.

8. A mold as called for in claim 1 wherein at least some of said coolant passageways are independent of others so that the flow of coolant in some of said passageways can be controlled independently of the coolant flow in other passageways.

9. A mold as called for in claim 1 wherein the cavity area of the mold is spaced laterally inwardly of the opposite ends of the mold sections and including conduits extending into opposite ends of the mold sections in spaced relation thereto and connected to said coolant passageways adjacent the laterally opposite ends of the cavity area whereby to concentrate the cooling to the cavity area of each mold section.

10. A mold as called for in claim 1 wherein said heating devices comprise passageways for conducting a heat medium, the cavity area of the mold being spaced laterally inwardly of the opposite ends of the mold sections and including two sets of conduits extending into opposite ends of the mold sections in spaced relation thereto, one set of said conduits being connected to said coolant passageways and the other to said passageways for said heating medium, the connections between said conduits and said passageways being directly adjacent the laterally opposite ends of the cavity area of the mold sections whereby to concentrate the cooling and heating of the mold sections to the cavity area of each mold section.

* * * * *